US010998106B2

(12) United States Patent
Nieder et al.

(10) Patent No.: US 10,998,106 B2
(45) Date of Patent: May 4, 2021

(54) ZINC DOSING FOR DECONTAMINATING LIGHT-WATER REACTORS

(71) Applicant: RWE POWER AKTIENGESELLSCHAFT, Essen (DE)

(72) Inventors: Dietmar Nieder, Karlsruhe (DE); David Jordan, Höxter (DE)

(73) Assignee: RWE POWER AKTIENGESELLESCHAFT, Essen (DE)

( * ) Notice: Subject to any disclaimer, the term of this patent is extended or adjusted under 35 U.S.C. 154(b) by 0 days.

(21) Appl. No.: 16/603,327

(22) PCT Filed: Mar. 5, 2018

(86) PCT No.: PCT/EP2018/055374
§ 371 (c)(1),
(2) Date: Oct. 7, 2019

(87) PCT Pub. No.: WO2018/184780
PCT Pub. Date: Oct. 11, 2018

(65) Prior Publication Data

US 2020/0051706 A1 Feb. 13, 2020

(30) Foreign Application Priority Data

Apr. 7, 2017 (DE) ..... 10 2017 107 584.4

(51) Int. Cl.
*G21F 9/00* (2006.01)
*G21F 9/12* (2006.01)

(52) U.S. Cl.
CPC ..... *G21F 9/004* (2013.01); *G21F 9/12* (2013.01)

(58) Field of Classification Search
CPC ..... G21F 9/00; G21F 9/004; G21F 9/12
USPC ..... 588/2
See application file for complete search history.

(56) References Cited

U.S. PATENT DOCUMENTS

| | | | | |
|---|---|---|---|---|
| 5,434,331 | A * | 7/1995 | Barkatt | C23G 1/02 134/10 |
| 2003/0070731 | A1 | 4/2003 | Petitjean et al. | |
| 2005/0105670 | A1 | 5/2005 | Kormuth et al. | |
| 2012/0138086 | A1 | 6/2012 | Gassen et al. | |
| 2013/0281341 | A1 | 10/2013 | Crytzer et al. | |
| 2014/0205052 | A1 | 7/2014 | Won et al. | |
| 2014/0378733 | A1 | 12/2014 | Park et al. | |
| 2015/0114845 | A1 | 4/2015 | Crytzer et al. | |
| 2015/0117587 | A1 | 4/2015 | Crytzer et al. | |

FOREIGN PATENT DOCUMENTS

| | | | |
|---|---|---|---|
| AT | 9719E | B1 | 2/1982 |
| CN | 103155047 | A | 6/2013 |
| CN | 105684094 | A | 6/2016 |
| JP | 2013-513098 | | 4/2013 |
| JP | 2015-521098 | | 7/2015 |
| WO | WO0078403 | A1 | 12/2000 |

OTHER PUBLICATIONS

Japanese Office Action dated May 28, 2020 (Japanese Patent Application No. 2019-5544828).
Jiang Suquing / The Effects of Zinc Injection on Corrosion Behaviors of PWR Primary Loop Structural Materials/School of Mechanical Engineering Shanghai Jiao Tong University / Feb. 23, 2011 / Shanghai, P.R.China.
China National Intellectual Property Administration / Notice on the First Office Action (PCT Application in the National Phase) / Apr. 14, 2020.
Japanese Patent Office—Office Action dated Nov. 10, 2020 (Japanese Patent Application No. 2019-554828).

* cited by examiner

*Primary Examiner* — Edward M Johnson
(74) *Attorney, Agent, or Firm* — Lott & Fischer, PL

(57) ABSTRACT

The invention relates to a method for decontaminating a radioactively contaminated metal surface, wherein the metal surface is brought in contact with a decontamination solution, which comprises a complexing agent and a transition metal. The invention further relates to such a decontamination solution and to the use thereof to decontaminate a metal surface.

10 Claims, 3 Drawing Sheets

ZINC DOSING FOR DECONTAMINATING LIGHT-WATER REACTORS

Figure 1:
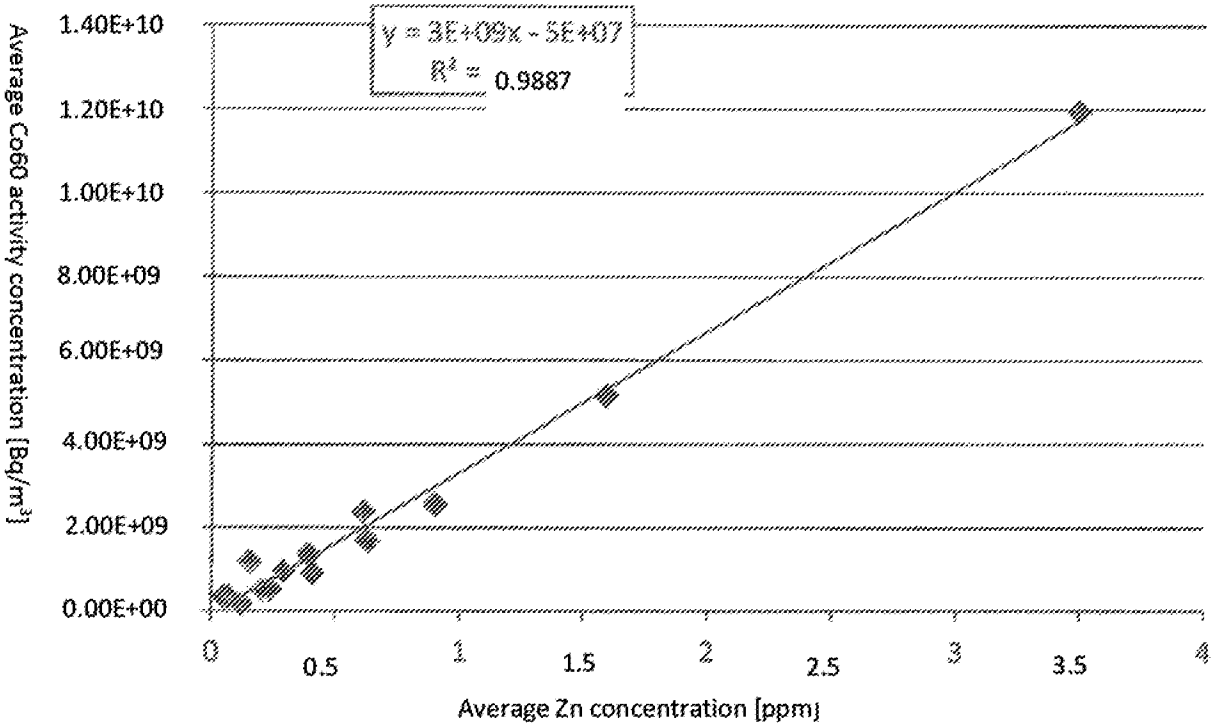

This application is a national phase of PCT Application No. PCT/EP2018/055374 Filed Mar. 5, 2018, which in turn claims the benefit of German Patent Application No. 10 2017 107 584.4 filed Apr. 7, 2017.

The present invention relates to a decontamination solution that contains zinc for decontaminating light-water reactors, and to a method for decontaminating radioactive metal surfaces using the decontamination solution.

In the field of nuclear reactor technology, metal components are radioactively contaminated. Such contamination routinely occurs during normal operation of reactors and relates in particular to metal components located in the primary circuit, for example of a pressurized water reactor. In this case, radioactive substances are deposited in the oxide layers formed on the surface of the components, causing them to become radioactively contaminated.

In the event of an inspection of the nuclear power station, it is routinely necessary to free the contaminated components from the radioactivity, i.e. from the deposits on the metal surface, in order to protect the inspection personnel from radiation. The components can then continue to be processed in the nuclear power station. The same applies if the nuclear power station is intended to be demolished.

In principle, mechanical means can be used to remove such deposits, wherein the oxide layers and therefore the contaminated regions are ground, for example. This is in particular disadvantageous for components that are difficult for the grinding tool to access due to their dimensions or their position.

Furthermore, it is known to decontaminate the components using a decontamination solution that comprises a complexing agent, which includes various carboxylic acids such as oxalic acid. In this case, the portions of the oxide layers of low solubility are first oxidized or reduced in a preceding step, with permanganates (potassium permanganate, permanganic acid) being used to oxidize Cr-III to Cr-VI, for example. The oxide layer, which mainly consists of iron and nickel ions, is then dissolved with the aid of the complexing agent and the released cations, which also include $^{60}Co^{2+}$ or $^{58}Co^{2+}$, are removed from the decontamination solution by means of ion-exchange. This decontamination process is usually carried out in several rounds, the oxide layer being broken down bit by bit.

In addition to these radioactive isotopes, inactive ions are also always released into the decontamination solution, which are likewise removed from the decontamination solution by means of the ion-exchange resins. Furthermore, recontamination of the components takes place as early as during the decontamination process as a result of the radioactive ions present in the decontamination solution. As a result, the efficiency of the decontamination process is reduced, leading to a larger number of decontamination cycles being required that are time-consuming and expensive, and also leading to a greater amount of contaminated ion-exchange resins that need to be disposed of, which requires an enormous amount of effort.

Of course, the above-mentioned problems do not only occur in nuclear power stations, but in principle in situations in which metal components come into contact with radioactivity and in which decontamination is required.

Accordingly, there is the need for an improved method for decontaminating radioactively contaminated metal surfaces. In particular, there is the need for a more efficient decontamination method, in which decontamination can be carried out by means of a smaller number of decontamination cycles and/or a smaller amount of contaminated ion-exchange resins.

This object is achieved according to the invention by a method having the features specified in claim 1. Embodiments are specified in the dependent claims.

More precisely, the method according to the invention is a method for decontaminating a radioactively contaminated metal surface, which comprises the step of bringing at least a portion of the radioactively contaminated metal surface into contact with a decontamination solution comprising a complexing agent and a transition metal. As could surprisingly be shown, when a transition metal is added to the decontamination solution, recontamination of the metal surface, which occurs during the decontamination process, is effectively reduced.

Without being limited hereto, it is assumed that the transition metal added to the decontamination solution competes with the radioactive isotopes released for (re-)incorporation in the metal surface (or the oxide layer thereon). As a result, a larger amount of radioactive isotopes can advantageously be removed from the decontamination solution by means of the ion-exchange process, which in turn reduces the number of rounds of the decontamination steps required and/or reduces the amount of ion-exchange resins to be disposed of.

The decontamination solution is preferably an aqueous solution. The transition metal is preferably an ion of the transition metal, more preferably a cation of the transition metal, even more preferably a bivalent or trivalent cation of the transition metal. Most preferably, the transition metal is a bivalent cation of the transition metal.

The transition metal is more preferably a depleted transition metal, i.e. a transition metal having a reduced proportion of isotopes compared with the proportion of isotopes that naturally occurs, which isotopes can be easily activated by neutrons. The use of a depleted transition metal is particularly advantageous when the metal to be decontaminated, for example the component of a reactor, is not disposed of after decontamination, but is recycled and intended to be subjected to neutron flux.

The transition metal is likewise preferably selected from the group consisting of zinc, nickel, cobalt or mixtures thereof. More preferably, the transition metal is selected from the group consisting of zinc and nickel. Most preferably, the transition metal is zinc. The use of zinc in the decontamination solution surprisingly showed the greatest effect when reducing the extent to which the metal surface is recontaminated, as per the invention.

The transition metal is preferably present in the decontamination solution in a concentration in the range of from ≥0.5 mg/kg to ≤15 mg/kg, more preferably from ≥0.5 mg/kg to ≤10 mg/kg, more preferably from ≥1.5 mg/kg to ≤5 mg/kg or from ≥2 mg/kg to ≤5 mg/kg, and most preferably from approximately 3 mg/kg to ≤4 mg/kg. Instead of mg/kg, mmol/L can also be stated, the stated mg/kg value having to be divided by the atomic weight of the particular transition metal. The transition metal is preferably present in the decontamination solution in a concentration in the range of from ≥7 μmol/L to ≤230 μmol/L, more preferably from ≥7 μmol/L to ≤155 μmol/L, more preferably from ≥23 μmol/L to ≤70 μmol/L or from ≥30 μmol/L to ≤80 μmol/L, and most preferably from approximately ≥46 μmol/L to ≤62 μmol/L.

The concentration ranges specified preferably hold true for the concentration of the transition metals when the metal surface is brought into contact with the decontamination solution according to the invention. The concentrations specified are likewise preferably the average concentrations.

In the following, reference will be made to the element zinc purely by way of example instead of to "transition metals". If applicable, the comments made also apply in a similar way to transition metals in general, and preferably also to nickel and/or cobalt.

The term "zinc" is preferably intended to be understood to mean the zinc ions present in the decontamination solution, more preferably $Zn^{2+}$. More preferably, this can be depleted zinc, in particular zinc depleted in $^{64}Zn$.

The zinc is more preferably introduced into the decontamination solution by means of a soluble zinc compound. Preferred soluble zinc compounds are selected from the groups of the acids used and/or the complexing agents used with zinc, comprising zinc methanesulfonate ($Zn(CH_3SO_3)_2$), zinc nitrate ($Zn(NO_3)_2$), zinc permanganate ($Zn(MnO_4)_2$), zinc sulfate ($ZnSO_4$) and/or a soluble zinc complex. The zinc complex is more preferably a complex of zinc and the complexing agent used.

The term "decontamination" is known to a person skilled in the art. This is intended to be understood in particular to mean the reduction and/or removal of radioactivity present on the metal surface. In particular, this is intended to be understood to mean the removal of a layer of metal oxide deposits on a metal component, the deposited layer comprising radioactive isotopes, preferably cobalt. In other words, by means of the method according to the invention, radioactive isotopes are removed from the metal surface to be decontaminated. These radioactive isotopes are preferably selected from the group consisting of $^{55}Fe$ ions, $^{63}Ni$ ions, $^{54}Mn$ ions, $^{65}Zn$ ions, $^{125}Sb$ ions, $^{137}Cs$ ions, $^{58}Co$ ions and $^{60}Co$ ions. The radioactive isotopes are more preferably selected from the group consisting of $^{54}Mn$ ions, $^{125}Sb$ ions, $^{137}Cs$ ions, $^{58}Co$ ions and $^{60}Co$ ions. These radioactive isotopes are most preferably $^{58}Co$ ions and/or $^{60}Co$ ions, even more preferably $^{60}Co$ ions. The decontamination method of the present invention can preferably also be referred to as chemical decontamination. More preferably, the decontamination method can be a method for decontaminating a nuclear reactor that is to be demolished or a nuclear reactor that shall continue to be operated.

The clearance of solid and liquid substances is regulated according to the Radiological Protection Ordinance (RPO, Strahlenschutzverordnung StrlSchV) and is substantially divided into unrestricted clearance and clearance for disposal on landfills. Following decontamination of the metal surface, what is preferably left is a component that is cleared for disposal on landfills. Following decontamination of the metal surface, what is even more preferably left is a component that is suitable for unrestricted clearance.

Hereinafter, the term "radioactively contaminated metal surface" is intended to preferably be understood to mean the surface of a metal component including the radioactively contaminated deposited layer located thereon, which forms during normal use of the component in a pressurized water reactor, for example. Such a deposited layer preferably consists of metal oxides of low solubility. In other words, the radioactive metal surface to be decontaminated preferably comprises at least one radioactively contaminated layer of metal oxides of low solubility, which layer is arranged on the surface and is made of basic metal material. More preferably, the deposited layer is spinels, preferably Cr—Ni spinels and/or Cr—Fe spinels. Spinels are minerals of low solubility from the mineral class of oxides and hydroxides, which are usually present in crystal form, and are preferably oxides having the amount-of-substance ratio of metal:oxygen=3:4.

The metal of the metal surface to be decontaminated can in principle be any suitable metal. The metal is preferably a metal selected from the group consisting of iron, nickel, chromium, manganese, titanium, niobium, copper, cobalt and combinations of at least two of these metals. The metal is more preferably selected from the group consisting of iron, chromium, nickel, cobalt and combinations of at least two of these metals.

According to the invention, at least a portion of the metal surface is also brought into contact with the decontamination solution. Preferably a plurality of portions, and more preferably the entire metal surface, is/are brought into contact with the decontamination solution. For better understanding, reference will be made to the radioactively contaminated metal surface in the following, even though a portion of said surface is also always meant thereby.

The radioactively contaminated metal surface can be brought into contact with the decontamination solution, as per the invention, in any suitable manner. The metal surface to be decontaminated is preferably wetted with the decontamination solution. The decontamination solution is more preferably introduced into the primary circuit of a reactor.

More preferably, the decontamination solution can be circulated. As a result, concentration gradients in the region of the metal surface can advantageously be avoided and the efficiency of the decontamination process can be increased. More preferably, circulation is continuous and is likewise preferably carried out using pumps.

Likewise preferably, the metal surface to be decontaminated is the inner lateral face of a metal and cylindrical component (such as a tube of a recuperator) and the decontamination solution is introduced into the cavity of the cylindrical component.

Before the method step of bringing the at least one portion of the metal surface into contact with the decontamination solution according to the invention, the method according to the invention preferably comprises an additional method step, i.e. as the first method step, for oxidizing or reducing the radioactively contaminated metal surface. In the case of oxidation, this method step can also be referred to as the pre-oxidation of the radioactively contaminated metal surface. More preferably, during pre-oxidation, Cr-III is oxidized to Cr-VI. Pre-oxidation is preferably carried out by bringing the radioactively contaminated metal surface into contact with nitric acid and potassium permanganate, with sodium hydroxide and potassium permanganate, a vanadium compound (preferably vanadium formate) or with permanganic acid, the permanganic acid treatment being the most preferable. In the case of a preceding reduction method step, the oxidation layer is preferably reduced by means of a vanadium compound. In the method step that follows this step, the dissolved products are preferably complexed with picolinic acid.

After the pre-oxidation step and before the at least one portion of the metal surface is brought into contact with the decontamination solution according to the invention, an additional method step can more preferably be carried out for reducing the excess oxidizing agent, for example the permanganate (potassium permanganate, permanganic acid).

After bringing the at least one portion of the metal surface into contact with the decontamination solution according to the invention, the method according to the invention likewise preferably comprises the additional method step of removing at least some of the radioactive isotopes, or ions thereof, present in the decontamination solution. These radioactive isotopes are preferably selected from the group consisting of $^{55}Fe$, $^{63}Ni$, $^{54}Mn$, $^{65}Zn$, $^{125}Sb$, $^{137}Cs$, $^{58}Co$ and $^{60}Co$. More preferably, the radioactive isotopes are selected from the group consisting of $^{54}Mn$, $^{125}Sb$, $^{137}Cs$, $^{58}Co$ and $^{60}Co$. These radioactive isotopes are most preferably $^{58}Co$ and/or $^{60}Co$, more preferably $^{60}Co$.

The radioactive isotopes are preferably removed by means of binding to an ion-exchange resin, more preferably a cation-exchange resin and/or a synthetic ion-exchange resin. Most preferably, the ion-exchange is a strongly acidic cation-exchange, in which protons are exchanged for the bound cations. Such ion-exchange resins are well-known to a person skilled in the art.

More preferably, approximately ≥50%, even more preferably approximately ≥70%, ≥80%, ≥90% or ≥99% of the radioactive isotopes present in the decontamination solution are removed. Most preferably, approximately ≥99% and <100% of the isotopes present in the decontamination solution are removed.

More preferably, the method according to the invention is cyclic. In other words, at least the method steps of bringing the metal surface into contact with the decontamination solution according to the invention and subsequently removing at least some of the radioactive isotopes present in the decontamination solution are repeated at least once. Of course, individual method steps or all the additional method steps mentioned above can also additionally be repeated in this case. The method according to the invention is preferably repeated until a decontamination factor has been reached that corresponds to a reduction in the activity of the radioactively contaminated metal surface from ≥1 to ≤3 orders, more preferably approximately 2 orders. The decontamination factor is preferably determined by measuring the activity of the ion-exchange resin used to remove the radioactive isotopes present in the decontamination solution, or by comparing the activity of the ion-exchange resin before and after carrying out the method according to the invention.

The method according to the invention is likewise preferably repeated in cycles from 1 to 30 times, more preferably from 10 to 25 times, even more preferably from 13 to 20 times. A range of from 13 to 17 cycles showed particularly good results when using oxalic acid.

According to the invention, in addition to the transition metal, the decontamination solution comprises at least one complexing agent. The complexing agent can also be referred to as a chelating agent. Together with metal ions, complexing agents form chelate complexes. Examples of complexing agents include acids, such as nitrilotriacetic acid, ethylenediaminetetraacetic acid, fluoric acid, phosphoric acid, oxalic acid, tartaric acid, citric acid and salts thereof.

The complexing agent is particularly preferably an acid. The decontamination solution also comprises water, as a result of which the aqueous components of the decontamination solution can be in their dissolved form. In other words, the decontamination solution is an aqueous solution.

The acid is preferably selected from the group consisting of carboxylic acid, methane sulfonic acid, oxalic acid, picolinic acid, nitric acid and citric acid. More preferably, the acid is a mixture of methane sulfonic acid and oxalic acid. The acid is most preferably oxalic acid. More preferably, the decontamination solution also contains an oxidizing agent, preferably permanganic acid, or a reducing agent. In other preferred embodiments, the decontamination solution contains zinc methane sulfonate, zinc nitrate, zinc permanganate, zinc sulfate and/or a zinc complex of the complexing agent used. The complex consisting of the transition metal and the complexing agent used is particularly preferred.

The use of the decontamination solution according to the invention to carry out the method according to the invention is likewise a component of this invention.

EXAMPLES

The figures show in detail:

FIG. 1 the correlation between the Zn concentration of the decontamination solution and the 60Co decontamination.

Figure 2:
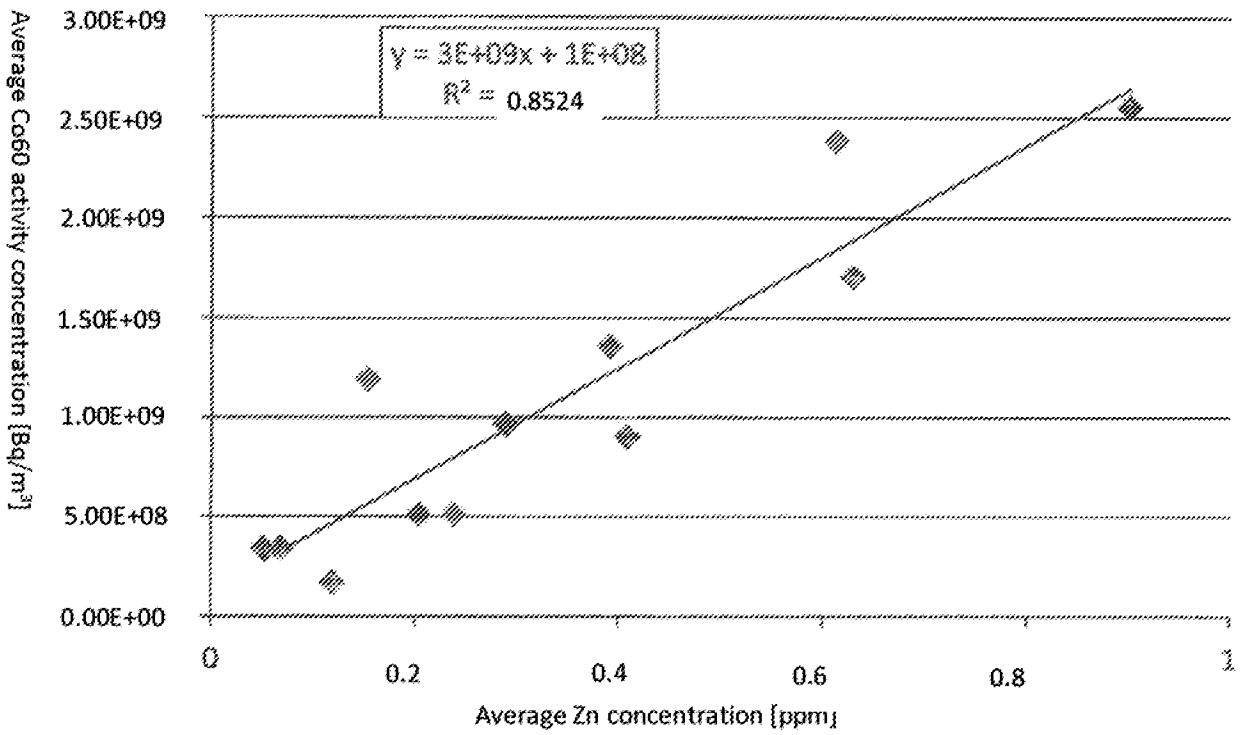

FIG. 2 the correlation between the Zn concentration of the decontamination solution and the 60Co decontamination.

Figure 3:
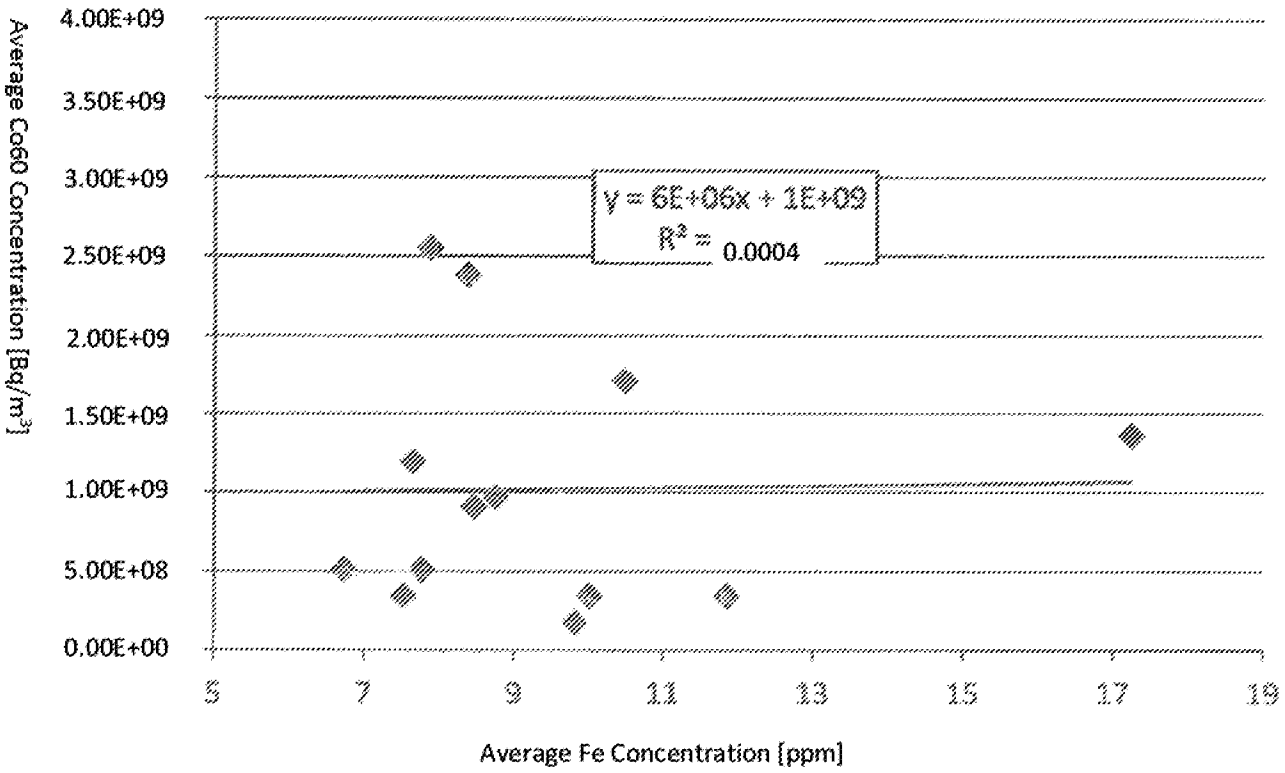

FIG. 3 the correlation between the Fe concentration of the decontamination solution and the 60Co decontamination.

EXAMPLE 1: CORRELATION BETWEEN THE ZN CONCENTRATION AND THE $^{60}CO$ DECONTAMINATION

Decontaminations of the primary circuit of a light-water reactor were carried out, whereby the average Zn and Fe concentration in the decontamination medium and the $^{60}Co$ removed from the decontamination solution in this case by means of the ion-exchange resin (strongly acidic cation-exchange) was determined. The primary circuit decontaminations were carried out over 15 cycles.

As can be seen in FIGS. 1 and 2 (determination of the $^{60}Co$ decontamination on the basis of the Zn concentration), there is a very good correlation between this transition metal and the amount of $^{60}Co$ removed.

In comparison thereto, it was not possible to demonstrate a very good correlation of this type between the Fe concentration and $^{60}Co$ (see FIG. 3).

EXAMPLE 2: CORRELATION BETWEEN THE NI CONCENTRATION OR CR CONCENTRATION AND THE $^{60}CO$ DECONTAMINATION

Example 1 was repeated, whereby the Ni concentration or the Cr concentration was observed instead of the Zn concentration. In this case, a correlation was likewise shown between the concentration of the transition metal and the activity removed by means of $^{60}Co$ in each case. The correlation determined decreased tendentially, and in comparison with Zn, from Ni by means of Cr.

The invention claimed is:

1. A method for decontaminating a radioactively contaminated metal surface, comprising the steps of:

bringing at least a portion of the metal surface into contact with a decontamination solution comprising a complexing agent selected from hydrofluoric acid, phosphoric acid, nitric acid, methane sulfonic acid and carboxylic acids, such as nitrilotriacetic acid, ethylenediaminetetraacetic acid, oxalic acid, tartaric acid, citric acid and picolinic acid and salts thereof, and an ion of a transition metal.

2. The method according to claim 1, wherein the ion of the transition metal is selected from the group consisting of zinc, nickel, cobalt or mixtures thereof.

3. The method according to claim 1, wherein the concentration of the transition metal lies in the range of from ≥0.5 to ≤15 mg/kg.

4. The method according to claim 1, wherein the ion of the transition metal is zinc and is present in a concentration in the range of from ≥2 to ≤5 mg/kg.

5. The method according to claim 1, wherein $^{58}Co$ and/or $^{60}CO$ ions are removed from the metal surface.

6. The method according to claim 1, wherein the decontamination solution is introduced into the primary circuit of a nuclear reactor.

7. The method according to claim 1, wherein the decontamination solution is circulated.

8. The method according to claim 1, wherein, as the first method step, the method comprises a pre-oxidation step or a reduction step for oxidizing or reducing the radioactively contaminated metal surface.

9. The method according to claim 1, wherein the method also comprises the step of:

removing at least some of the radioactive isotopes present in the decontamination solution.

10. The method according to claim 9, wherein all the method steps are repeated at least once.

* * * * *